US008932100B2

(12) United States Patent
Saunders et al.

(10) Patent No.: US 8,932,100 B2
(45) Date of Patent: Jan. 13, 2015

(54) TOY FIGURE WITH COORDINATED MOVEMENTS

(71) Applicant: Mattel, Inc., El Segundo, CA (US)

(72) Inventors: Jeffrey A Saunders, Redondo Beach, CA (US); James P Zielinski, Hawthorne, CA (US)

(73) Assignee: Mattel, Inc., El Segundo, CA (US)

( * ) Notice: Subject to any disclaimer, the term of this patent is extended or adjusted under 35 U.S.C. 154(b) by 166 days.

(21) Appl. No.: 13/863,291

(22) Filed: Apr. 15, 2013

(65) Prior Publication Data

US 2013/0280986 A1 Oct. 24, 2013

Related U.S. Application Data

(60) Provisional application No. 61/623,816, filed on Apr. 13, 2012.

(51) Int. Cl.
*A63H 3/20* (2006.01)
*A63H 13/04* (2006.01)
*A63H 3/28* (2006.01)

(52) U.S. Cl.
CPC ..... *A63H 3/20* (2013.01); *A63H 13/04* (2013.01); *A63H 3/28* (2013.01)
USPC ..... 446/330

(58) Field of Classification Search
USPC ..... 446/268, 330, 331, 337, 338, 339, 341, 446/342, 343, 352, 376, 390, 391
See application file for complete search history.

(56) References Cited

U.S. PATENT DOCUMENTS

| | | | | | |
|---|---|---|---|---|---|
| 2,137,371 | A | | 11/1938 | Marsh | |
| 2,648,161 | A | | 8/1953 | Stewart | |
| 2,727,334 | A | | 12/1955 | Ostrander | |
| 3,147,566 | A | | 9/1964 | Ong | |
| 3,242,611 | A | * | 3/1966 | Henry | 446/338 |
| 3,250,037 | A | | 5/1966 | Katz et al. | |
| 3,295,253 | A | * | 1/1967 | Gardel et al. | 446/338 |
| 3,475,853 | A | | 11/1969 | Alder | |
| 3,494,068 | A | | 2/1970 | Crosman | |
| 3,648,405 | A | | 3/1972 | Tepper | |
| 3,700,384 | A | * | 10/1972 | Gardel et al. | 446/266 |
| 3,724,125 | A | * | 4/1973 | Goldfarb et al. | 446/330 |
| 3,851,418 | A | | 12/1974 | Barlow et al. | |
| 4,003,158 | A | | 1/1977 | Wolf et al. | |
| 4,141,176 | A | | 2/1979 | Flicker et al. | |
| 4,217,726 | A | | 8/1980 | Flicker et al. | |
| 4,244,138 | A | * | 1/1981 | Holahan et al. | 446/301 |
| 4,356,928 | A | | 11/1982 | Stafford | |

(Continued)

*Primary Examiner* — Kurt Fernstrom
(74) *Attorney, Agent, or Firm* — Kolisch Hartwell, PC

(57) ABSTRACT

Animated toy figures including a torso having a neck and an interior body cavity, a head that is pivotally coupled to the neck, a vertically oriented lifting structure, where an upward movement of the lifting structure results in a backward pivoting of the head, first and second arm members disposed on opposing sides of the torso, a cross-connector rotatably disposed within the interior body cavity connected to and extending between the first and second arm members and configured to drive the lifting structure upward upon rotation of the cross-connector, and an activating member disposed on the torso that is operatively coupled to the cross-connector. Activation of the activating member rotates the cross-connector, thereby rotating the first and second arm members and vertically displacing the lifting structure, so that the upward movement of the arm members is coupled to a backward pivoting of the head.

20 Claims, 6 Drawing Sheets

(56) References Cited

U.S. PATENT DOCUMENTS

| | | | | | |
|---|---|---|---|---|---|
| 4,457,097 | A | * | 7/1984 | Miller et al. | 446/327 |
| 4,560,362 | A | | 12/1985 | Renger | |
| 4,578,045 | A | | 3/1986 | Mayer et al. | |
| 4,579,542 | A | | 4/1986 | Mayer et al. | |
| 4,596,532 | A | | 6/1986 | Cook et al. | |
| 4,601,672 | A | | 7/1986 | Cook et al. | |
| 4,605,382 | A | | 8/1986 | Cook et al. | |
| 4,608,026 | A | | 8/1986 | Newton et al. | |
| 4,623,318 | A | * | 11/1986 | Tsiknopoulos et al. | 446/330 |
| 4,968,280 | A | * | 11/1990 | Kelley | 446/330 |
| 5,304,087 | A | | 4/1994 | Terzian et al. | |
| 5,651,717 | A | * | 7/1997 | Hamilton et al. | 446/330 |
| 5,964,638 | A | * | 10/1999 | Emerson | 446/339 |
| 6,012,962 | A | | 1/2000 | Arriola | |
| 6,022,263 | A | * | 2/2000 | Liu et al. | 446/379 |
| 6,152,799 | A | | 11/2000 | Arriola | |
| 6,171,169 | B1 | * | 1/2001 | Saunders | 446/308 |
| 6,224,456 | B1 | * | 5/2001 | Wittenberg | 446/330 |
| 6,431,941 | B1 | * | 8/2002 | Frawley et al. | 446/330 |
| 6,572,433 | B1 | * | 6/2003 | Hou | 446/353 |
| 6,575,808 | B1 | * | 6/2003 | Wright et al. | 446/321 |
| 2007/0128973 | A1 | * | 6/2007 | Blagg et al. | 446/334 |
| 2010/0093254 | A1 | | 4/2010 | Jung | |
| 2011/0130070 | A1 | | 6/2011 | Hong | |

* cited by examiner

TOY FIGURE WITH COORDINATED MOVEMENTS

CROSS-REFERENCE TO RELATED APPLICATIONS

This application claims the benefit under 35 U.S.C. §119 (e) of the filing date of provisional patent application ser. No. 61/623,816 for TOY FIGURE WITH COORDINATED MOVEMENTS, filed Apr. 13, 2012, the disclosure of which is herein incorporated by reference for all purposes.

TECHNICAL FIELD

The present disclosure relates generally to animated toy figures, and more particularly to animated toy figures capable of simultaneous coordinated movements of multiple body portions.

BACKGROUND

Children and adults enjoy a variety of toy figures, such as action figures and dolls, which can be manipulated to simulate real life and fantastical activities, and assume natural and supernatural poses and positions. Hopefully, these toy figures stimulate the imaginations of children by providing a variety of play options.

One way of increasing the available play options is to provide toy figures capable of realistic movements. The types of movements that may typically be considered more realistic tend to involve multiple body elements moving in a coordinated fashion. Unfortunately, it can be difficult for a child, even an older child, to coordinate the movement of multiple activating members so that the overall movement of the toy figure appears realistic. It is often preferable, particularly for younger children, for a toy figure to have a single activating member that then activates the coordinated movement of multiple body elements.

Examples of toy figures that are capable of activatable movement of body elements may be found in U.S. Pat. Nos. 2,137,371, 2,648,161, 2,727,334, 3,147,566, 3,242,611, 3,250,037, 3,295,253, 3,475,853, 3,494,068, 3,648,405, 3,700,384, 3,724,125, 3,851,418, 4,003,158, 4,217,726, 4,141,176, 4,244,138, 4,356,928, 4,560,362, 4,578,045, 4,579,542, 4,596,532, 4,601,672, 4,605,382, 4,608,026, 4,623,318, 4,968,280, 5,651,717, 6,012,962, 6,022,263, and 6,152,799; and in U.S. Patent Publications US20100093254, and US20110130070. The complete disclosures of the above patents and patent applications are herein incorporated by reference for all purposes.

SUMMARY

In one aspect of the invention, the invention includes an animated toy figure having a torso that includes a neck and an interior cavity; a head that is pivotally coupled to the neck, a lifting structure configured to pivot the head backward when the lifting structure is moved upward, a first arm member and a second arm member disposed on opposing sides of the torso member, a cross-connector that is rotatably disposed within the interior cavity so that it connects to and extends between the first and second arm members, and an activating member disposed on a back surface of the torso, the activating member being coupled to the cross-connector. The toy figure is configured so that activation of the activating member rotates the cross-connector and urges the lifting structure upward upon, thereby pivoting the first and second arm members as well as urging the lifting structure upward, and coordinating the movement of the arm members and the backward pivoting of the head.

In an alternative aspect of the invention, the invention includes an animated toy figure having a torso, a head that is pivotally coupled to the torso that includes a pair of projecting ears and a face that has eyes, a first and a second arm members disposed on opposing sides of the torso, and an activating member disposed on the torso. The toy figure is configured so that activation of the activating member concurrently moves the first and second arm members upwardly, tilts the head backwards, moves the ears backwards, and closes the eyes of the figure.

In another alternative aspect of the invention, the invention includes a method of making a toy figure, where the method includes providing a torso member having a neck portion and opposing shoulders, the torso member defining a torso interior; pivotally coupling a head member to the neck portion of the torso member; disposing a cross-connector within the torso interior so that one end of the cross-connector is at each shoulder of the torso member, and the cross-connector extends between the opposing shoulders; coupling a first arm member and second arm member to the ends of the cross-connector, such that the arm members are disposed at opposing shoulders of the torso member, and such that rotation of the cross-connector pivots the first and second arm members around their respective opposing shoulders; coupling a lifting structure to and between the cross-connector and the head member, such that rotation of the cross-connector urges the lifting structure upward and thereby pivots the head member backwards; installing an activating member on a rear surface of the torso member; and coupling the activating member to the cross-connector, such that an activation of the activating member rotates the cross-connector, pivots the first and second arm members, urges the lifting structure upward, and tilts the head member backward.

The present disclosure relates generally to animated toy figures having a torso with a neck and an interior body cavity, a head that is pivotally coupled to the neck, and a vertically oriented lifting structure where an upward movement of the lifting structure results in a backward pivoting of the head, first and second arm members disposed on opposing sides of the torso, a cross-connector rotatably disposed within the interior body cavity connected to and extending between the first and second arm members and configured to drive the lifting structure upward upon rotation of the cross-connector, and an activating member disposed on the torso that is operatively coupled to the cross-connector. Activation of the activating member rotates the cross-connector, thereby rotating the first and second arm members and vertically displacing the lifting structure, so that the upward movement of the arm members is coupled to a backward pivoting of the head.

Advantages of the present invention will be more readily understood after considering the drawings and the Detailed Description.

BRIEF DESCRIPTION OF THE DRAWINGS

FIG. 7 depicts the relationships between the activating member, the cross-connector, the lifting structure, the head, and the ears of the toy figure.

DETAILED DESCRIPTION OF THE PREFERRED EMBODIMENTS

Figure 1:
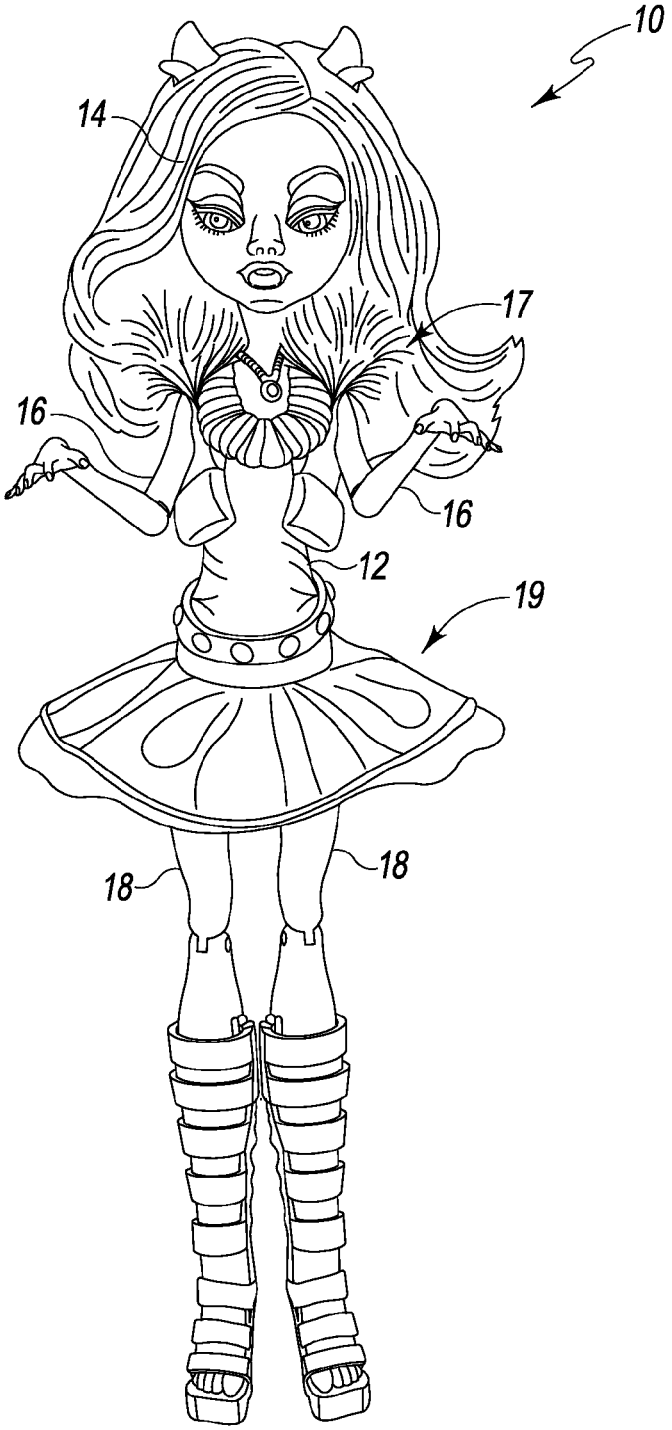
FIG. 1 depicts an exemplary animated toy figure according to an embodiment of the present invention.

FIG. 1 depicts an animated toy figure 10, that includes a torso 12 and a head 14 that is pivotably connected to the torso at a neck portion 15 of the torso. The toy figure additionally includes a first and second arms 16 that typically are coupled to the torso 12 at a shoulder portion 17 of the torso, and legs 18 that typically are coupled to the torso 12 at a hip portion 19. Arms 16 and legs 18 may be coupled to torso 12 via an articulated joint. For example, each of arms 16 and legs 18 may be pivotally coupled to torso 12. Similarly, each of arms 16 and legs 18 may include one or more further points of articulation, such as knee, elbow, wrist, or ankle joints. Each such point of articulation may provide one or more degrees of freedom, such as a hinge joint, a pivot joint, or a ball joint, among others.

Figure 2:
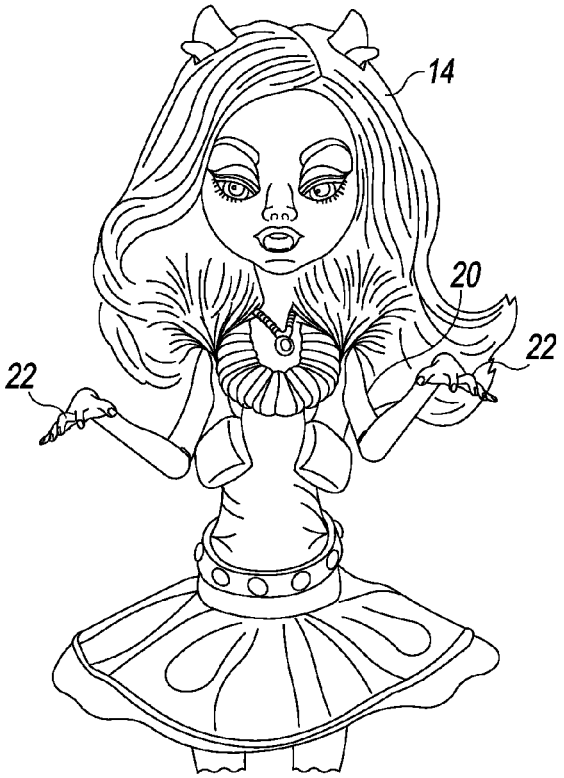
FIG. 2 depicts the exemplary animated toy figure of FIG. 1 before activation of an activating member.

Some embodiments of the toy figure of the present invention may be configured to exhibit coordinated movement of multiple body portions upon the activation of an activating member. For example, selected toy figures of the present disclosure may be configured such that upon activation of an activating member, both the first and second arms 16 pivot at the shoulder of the toy figure, while at the same time the head 14 tilted upward and/or backward. For example, the toy figure 10 may begin in an initial pose or conformation as shown in FIG. 2, with the head 14 facing forward, and both arms 16 in a lowered position. For the purposes of this disclosure, a lowered arm position corresponds to the upper arm portion 20, from shoulder to elbow, extending at least substantially downward from the attachment point of the arm 16 to the torso 12, as shown in FIG. 2.

Figure 3:
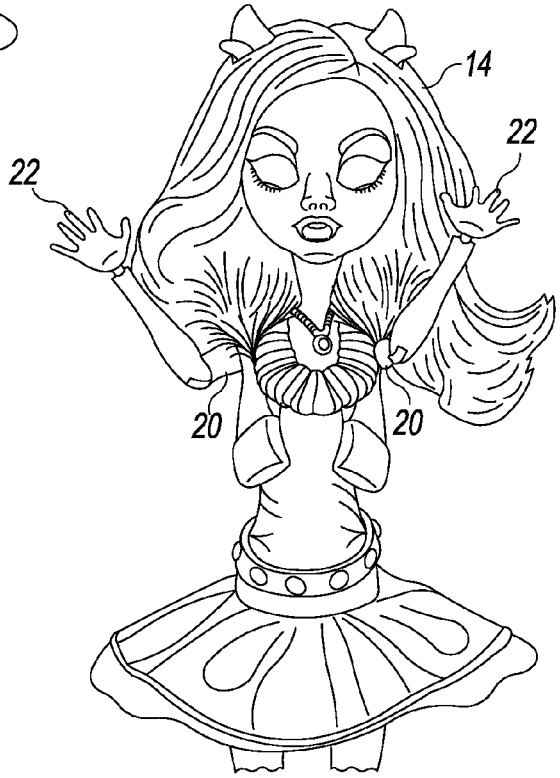
FIG. 3 depicts the exemplary animated toy figure of FIG. 2 after activation of an activating member.

Upon activation of an activating member (not shown), both arms may pivot with respect to the shoulder joint while the head of the toy figure tilts backwards at the pivotal connection between the head 14 and torso 12. As shown in FIG. 3, the arms may pivot upwardly upon activation. The extent to which the arms may pivot is not limited, provided that the resulting arm motion is large enough to be clearly evident to a user. As shown in FIGS. 2 and 3, the upper arm portion 20 may pivot from a position angled generally downward to a second position where the upper arms extend nearly horizontally.

Although the posability of arms 16 may permit the hands 22 of the toy figure to be placed in a variety of positions, in one embodiment of the invention the activation of the activating member may result in the hands 22 of the toy figure being raised adjacent to or approximately level with the head of the toy figure 10 while the head is tilted backward, as shown in FIG. 3.

Alternatively, or in addition, the toy figure 10 may begin in an initial pose that includes an appearance that the figure has open eyes, as shown in FIG. 2, but upon activation of the activating member and as the head of the toy figure tilts backwards, the eyes may give an appearance that they are closing, as shown in FIG. 3.

The activating member typically is readily accessible to the toy user, and may be directly or indirectly coupled to at least the arms and head of the toy figure via an appropriate coupling mechanism. The activating member may be coupled to the arms and head of the toy figure in any manner that results in the desired coordinated movements. Typically, the activating member is coupled to the arms and head of the toy figure via a cross-connector disposed within the torso that that is connected to the first and second arm members 16 and coupled to the head 14.

Figure 4A:
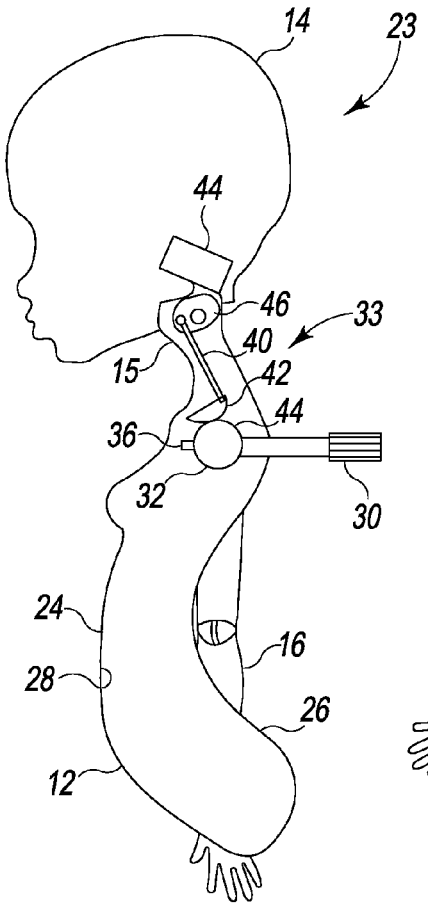
FIG. 4 is a semi-schematic cutaway view of a torso of a toy figure according to an embodiment of the present invention, illustrating an exemplary conformation of the toy figure before (FIG. 4A) and after (FIG. 4B) activation of an exemplary coupling mechanism.
Figure 4B:
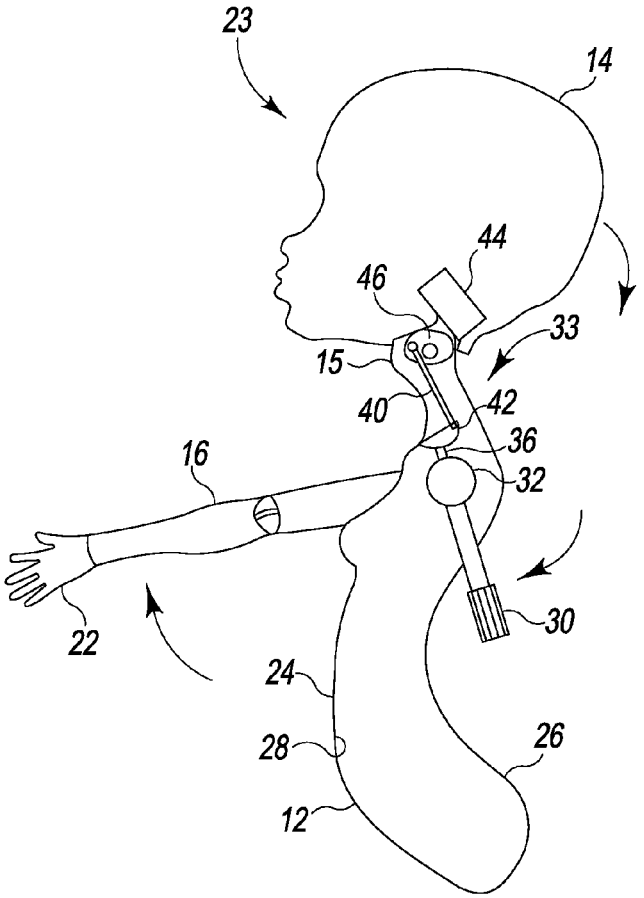

As depicted in FIGS. 4A and 4B, in one embodiment of the present invention, a toy figure 23 may include a head member 14, arm members 16, and a torso 12 that includes a front torso shell 24 and a rear torso shell 26 that combine to enclose and define an interior cavity 28 within the torso 12. In this embodiment, activating member 30 may be disposed on a rear surface of torso 12 (i.e. on rear torso shell 26) and may include a lever coupled directly and mechanically to a cross-connector 32. Cross-connector 32 typically is disposed within the torso interior cavity 28 so that it is connected to and extends between the first and second arm members 16. By depressing the lever of activating member 30 downward, cross-connector 32 is thereby rotated in a clockwise direction (with respect to the orientation of FIGS. 4A and 4B).

Figure 5:
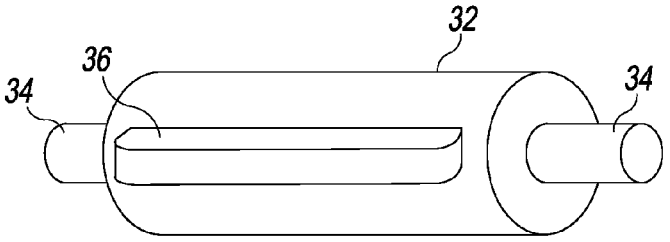
FIG. 5 is a schematic perspective view of a cross-connector according to an exemplary embodiment of the present invention.

Cross-connector 32 typically is additionally coupled to head 14 by a lifting structure 33 in such a manner that rotation of cross-connector 32 also pivots the head 14 along a pivotable connection between head member 14 and a neck portion 15 of torso 12. The lifting structure typically is oriented substantially vertically, as head member 14 will typically be disposed above the torso of the toy figure during play. An exemplary cross-connector 32 is depicted schematically in FIG. 5, and includes a first and second ends 34, which are configured to connect to the first and second arm members 16, respectively, at opposite sides of torso 12. Preferably cross-connector 32 connects to each arm member 16 at a shoulder portion 17 of the torso 12, such that rotation of the cross-connector causes the arm members to pivot at the shoulder joint. In addition, exemplary cross-connector 32 includes a cam lifter 36 that extends in a radial fashion from the axis of rotation of the cross-connector.

As cross-connector 32 is rotated, cam lifter 36 is moved in an upward direction. At the lower end of lifting rod 40, a cam 42 rests upon cross-connector 36 in such a fashion that rotation of the cross-connector brings cam lifter 36 into contact with cam 42 with a subsequent displacement of the cam in an upward direction. Cam 42 is coupled to head 14 via lifting rod (or push rod) 40, and head mount 44. Head mount 44 is pivotally coupled to neck portion 15 of torso 12, while head member 14 is mounted upon head mount 44. As cross-connector 32 rotates, cam lifter 36 turns upward, which in turn slidably uplifts cam 42 and thereby translates lifting rod 40 upward and pivoting head mount 44 about the pivotable connection 46 between the head mount and the neck portion 15, resulting in head member 14 pivoting in a backward direction. In one aspect of the invention, the pivotable connection 46 between head member 14 and neck portion 15 is configured to permit the head member to tilt backwards approximately 60 degrees.

By virtue of the construction of the coupling mechanism, the user is able to simultaneously lift up both of the toy figure's arms and tilt the figure's head backward by depressing a single lever. In performing this coordinated movement of multiple body elements, the movement of the toy figure appears more realistic and entertaining.

Figure 6A:
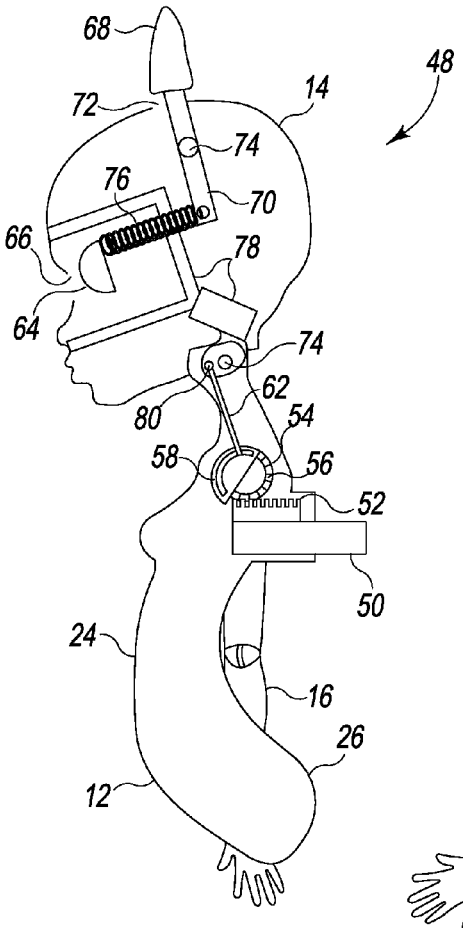
FIG. 6 is a semi-schematic cutaway view of a torso of a toy figure according to an alternative embodiment of the present invention, illustrating an exemplary conformation of the toy figure before (FIG. 6A) and after (FIG. 6B) activation of an exemplary coupling mechanism.
Figure 6B:
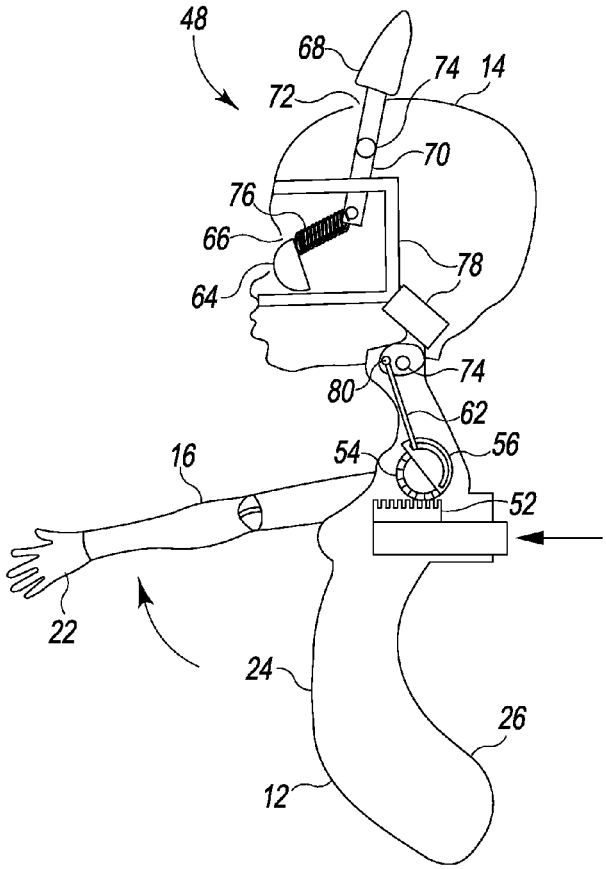

A toy figure 48 according to an alternative embodiment of the invention is shown in FIGS. 6A and 6B. Toy figure 48 includes an activating member 50 disposed on the back of the torso 12 that is configured to be depressed, or inserted, into the torso 12 of the figure. The activating member 50 may be configured to resist such depression, for example by the urging of a biasing member such as a spring, a resilient polymer, or other biasing mechanism (not shown).

In this embodiment, activating member 50 includes a rack portion 52 that is configured to interact with a pinion 54 on a cross-connector 56. As activating member 50 is depressed, the interaction between rack portion 52 and pinion 54 results in a rotation of cross-connector 56.

Similar to the embodiment of FIGS. 4A and 4B, cross-connector 56 is coupled at each end to one of the arm members 16, and therefore the rotation of cross-connector 56 results in the upward pivoting of arms 16. However toy figure 48 uses an alternative coupling mechanism to trigger the movement of head member 14. In particular, cross-connector 56 includes a slot 58, which serves as a guide for the lower end 60 of lifting rod 62 which is slidably secured by slot 58. The track of slot 58 spirals slightly outwardly from the axis of rotation of cross-connector 56 over the length of the slot, so as cross-connector 56 is rotated, lifting rod 62 is urged upwardly as the lower end 60 slides within the spiral slot.

In yet another embodiment of the present invention, the toy figure may incorporate one or more additional features that give the appearance that the toy figure closes its eyes as the head member is tilted backwards. This change in appearance of the toy figure's eyes typically is simultaneous with one or both of the tilting of the head member and the lifting of arms 16. In yet another embodiment of the present invention, the coupling mechanism is extended to coupled to a pair of ears disposed on the head of the toy figure, and activating the activating mechanism additionally moves the ears of the toy figure backwards.

In one exemplary mechanism, the closing of the toy figure's eyes is simulated by the presence of eye-shaped apertures in the face of the toy figure, wherein simulated eyes that include depictions of both eyes and eyelids are pivotably mounted within the head of the figure. In this embodiment, simulated eyes are weighted, so that when the head is in its lower position, the depicted eyes are visible through the apertures, but as the head tilts backward, the simulated eyes pivot to display the simulated eyelids via the eye-shaped apertures. As the head returns to its original position, the eyelids appear to open again as the weighted eyelids pivot back to their starting position.

In an alternative and exemplary mechanism, head 14 encloses eye surfaces 64 which include depictions of both eyes and eyelids, and which are visible through two eye-shaped apertures 66 in the face portion of head 14. In addition, two ears 68 extend from head 14, with each ear 68 being mounted on an ear support 70 that protrudes through an aperture 72 defined in head 14, as depicted semi-schematically in FIGS. 6A and 6B.

An ear support 70 is disposed within head 14, and the ear support 70 is secured via a pivot point 74 so that the ear support 70 is permitted to rotate about the pivot point 74. At the same time, a biasing member 76 urges the lower end of ear support 70 in a forward direction (with respect to the head of the toy figure). Due to the presence of pivot point 74, the forward bias results in ears 68 being urged backwards into contact with the rear lip of aperture 72 in the head of the toy figure, through which the ear support protrudes.

In this depicted embodiment, head 14 of FIGS. 6A and 6B is securely attached to a pivotable head mount 78, which is pivotally secured to neck portion 15 of torso 12 at a pivotable connection 46. Lifting rod 62 is also attached to head mount 78 at 80. However, neither eye surfaces 64, nor ears 68, nor ear supports 70 are attached to the interior surface of head 14, so the movement of head 14 does not directly move either the eye surfaces or the ear supports.

In operation, and substantially as discussed above, the depression of activation member 50 causes the rotation of cross-connector 56, driving lifting rod 62 upward, and thereby pivoting head mount 78. As head 14 is secured to head mount 78, head 14 is thereby tilted backwards. However, as the eye surfaces 64 are not attached to the interior of head 14, as eye apertures 66 shift upwardly with respect to the eye surfaces, the portion of each eye surface that is exposed changes. Typically, the color and design of eye surface 64 is such that by tilting head 14 and shifting the eye openings relative to the eye surface, an impression is created that the eyelids of the toy figure are closing.

Alternatively, or in addition, as head 14 tilts backwards, each ear aperture 72 necessarily also moves backwards. Due to the bias applied by biasing member 76, ear support 70 rotates as head 14 tilts backwards, keeping the upper portion of ear support 70 in contact with the rear lip of aperture 72. In this way, as head 14 tilts backwards, ears 68 also appear to tilt backwards, giving the impression that ears 68 of the toy figure are being laid back. In one embodiment of the invention, as cross-connector 56 is rotated, head 14 is configured to tilt backwards by approximately 60-degrees.

Figure 7:
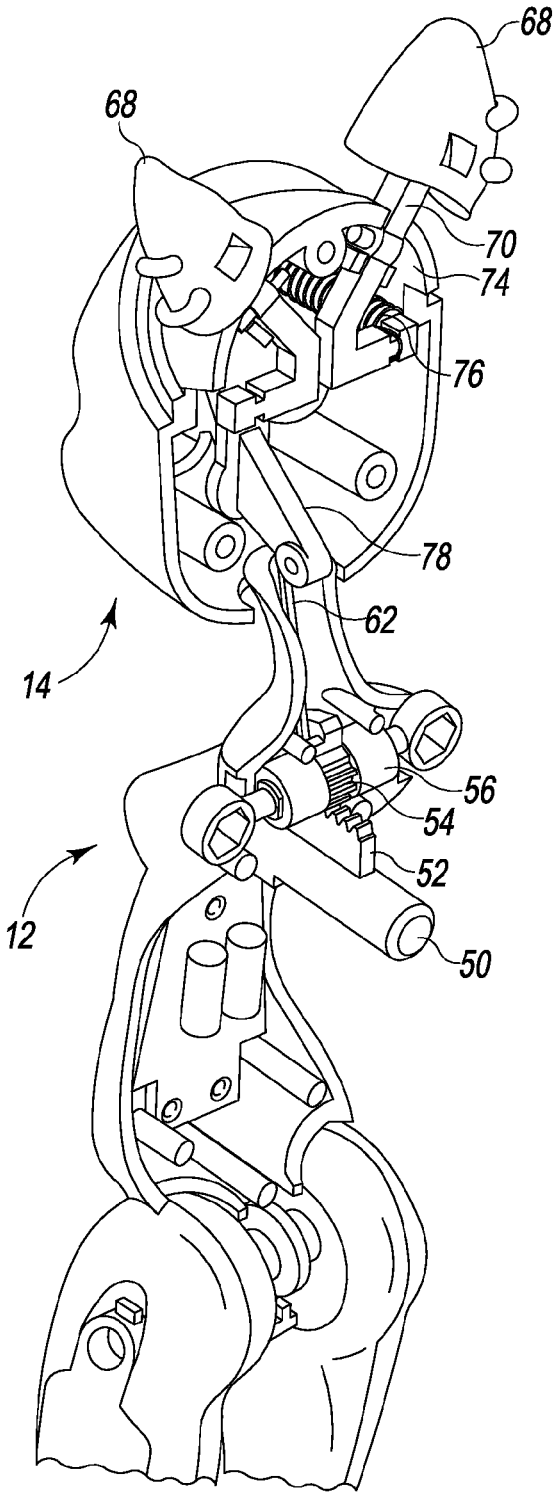
FIG. 7 is a schematic depiction of an alternative exemplary toy figure according to an embodiment of the present invention, depicting an exemplary coupling mechanism disposed within the head and torso of the toy figure. In particular.

With reference to FIG. 7, the coupling mechanism described in semi-schematic fashion in FIGS. 4A and 4B is shown in a perspective cutaway view of a representative toy figure of the present invention. The rear surfaces of the head and the torso portions of the figure are not shown in FIG. 7 to highlight the coupling mechanism and its relative position within the toy figure.

Figure 8:
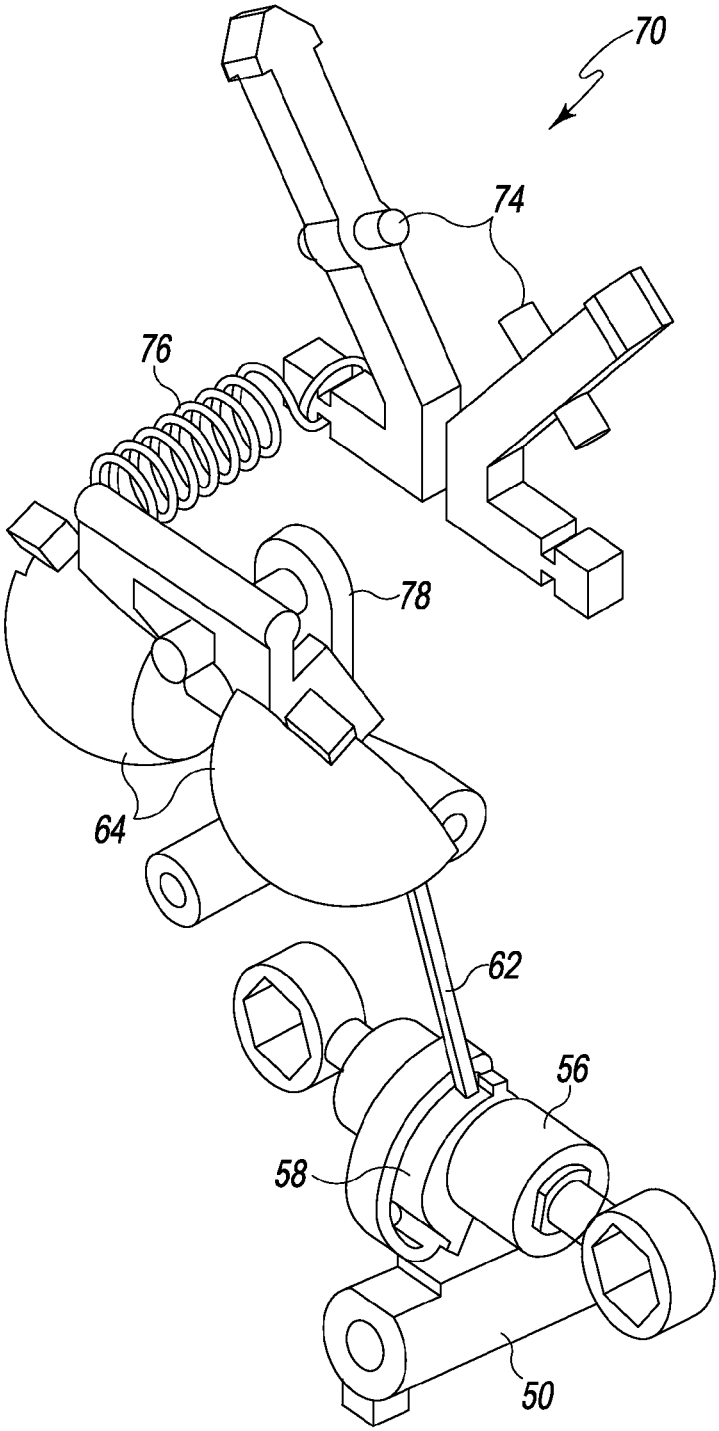
FIG. 8 is a schematic depiction of the coupling mechanism of FIG. 7, showing the relationship between the activating member, the cross-connector, the lifting structure, the eyes, and the ear supports of the toy figure.

With reference to FIG. 8, selected components of the coupling mechanism of FIG. 7 are shown in isolation and from a front top perspective.

In yet another embodiment of the invention, the animated toy figure may be configured to emit prerecorded or electronically generated sounds and/or sound effects via the inclusion of a sound effects generator. The generated sound effects may include music samples. The generated sound effects may include speech, either recorded or synthesized. The recorded speech may include one or more phrases associated with a character that is represented by the toy figure. The generated sound effects may include sounds characteristic of one or more of the actions for which the toy figure is configured. In one embodiment, the sound effect generator is configured to emit a sound effect that is a howling sound effect upon activation of the activation member.

Where the toy figure of the disclosure includes a sound effects generator, the sound effects generator may include one or more sound chips, or chips that include one or more integrated circuits designed to produce a sound or sounds. Additionally, the sound effects generator may include one or more speakers for producing the desired sound effect(s). Where the toy figure includes a speaker, the speaker may be mounted at the rear of the figure's head. Where the toy figure of the disclosure includes a sound effects generator, the toy figure may be marketed with one or more batteries adapted to power the sound effects generator. Alternatively or in addition, the toy figure may be marketed with one or more batteries already in place, so that a potential buyer may activate the toy figure to hear the sound effect(s) produced by the toy figure.

The animated toy figure may be optionally configured to emit a selected prerecorded sound concurrently with one or more of: raising the figure's first and second arm members, tilting the figure's head backwards, closing the figure's eyes, and moving the figure's ears backwards.

The animated toy figure may be configured to represent or resemble a particular character, such as a superhero, goodguy, villain, television character, or the like. In one embodiment, the animated toy figure is configured to resemble a character that is a werewolf. In some embodiments, the werewolf is a female werewolf.

In one embodiment of the animated toy figure of the invention, the toy figure may be approximately 10-15 inches in height. In another embodiment, the toy figure may be approximately 11-12 inches in height. The toy figure is optionally clothed and/or marketed along with one or more clothing outfits. The outfits provided with the toy figure may be removable, and are typically consistent with the character represented by the toy figure.

The various components of the animated toy figure disclosed herein may be fabricated from any suitable material, or combination of materials, such as plastic, foamed plastic, wood, cardboard, pressed paper, metal, or the like. A suitable material may be selected to provide a desirable combination of weight, strength, durability, cost, manufacturability, appearance, safety, and the like. More particularly, the materials used to fabricate the components of the animated toy figure include one or more plastics. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, or the like. Suitable foamed plastics may include expanded or extruded polystyrene, or the like.

Although the present invention has been shown and described with reference to the foregoing operational principles and preferred embodiments, it will be apparent to those skilled in the art that various changes in form and detail may be made without departing from the spirit and scope of the invention. The present invention is intended to embrace all such alternatives, modifications and variances that fall within the scope of the appended claims.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the disclosure recites "a" or "a first" element or the equivalent thereof, such recitation should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

What is claimed is:

1. An animated toy figure comprising:

a torso member defining a neck portion and an interior cavity;

a head member that is pivotally coupled to the neck portion;

a lifting structure, configured to pivot the head member backward when the lifting structure is moved upward;

a first arm member and a second arm member disposed on opposing sides of the torso member;

a cross-connector that is rotatably disposed within the interior cavity so that it is connected to and extends between the first and second arm members;

wherein rotation of the cross-connector pivots the first and second arm members where they connect to the cross-connector, and urges the lifting structure upward upon; and an activating member disposed on a back surface of the torso, the activating member being coupled to the cross-connector;

wherein activation of the activating member rotates the cross-connector and thereby pivots the first and second arm members, and urges the lifting structure upward, thereby resulting in coordination between a movement of the first and second arm members and a backward pivoting of the head member.

2. The animated toy figure of claim 1, wherein activation of the activating member pivots the first and second arm members in an upward motion.

3. The animated toy figure of claim 1, wherein the activating member includes a lever, where the lever is coupled to the cross-connector in such a way that moving the lever rotates the cross-connector.

4. The animated toy figure of claim 1, wherein the activating member includes a button, where the button is coupled to the cross-connector in such a way that depressing the button rotates the cross-connector.

5. The animated toy figure of claim 4, wherein the cross-connector includes an integral pinion, and the button is coupled to the cross-connector via a rack that is complementary to and coupled with the integral pinion.

6. The animated toy figure of claim 1, wherein the lifting structure includes a vertically oriented lifting rod that is pivotally coupled at an upper end to the head member.

7. The animated toy figure of claim 6, wherein, the lower end of the lifting rod is connected to a cam, and the cross-connector includes a lifting surface configured to interact cooperatively with the cam, such that when the cross-connected is rotated, the lifting surface engages the cam and thereby urges the lifting rod upward.

8. The animated toy figure of claim 6, wherein the cross-connector includes a spiral surface, and the lower end of the lifting rod is slidably coupled to the spiral surface, such that rotation of the cross-connector urges the lifting rod upward.

9. The animated toy figure of claim 1, wherein the head member defines two eye apertures, and the toy figure further comprises two eyelid members disposed within the head member such that the backward pivoting of the head member renders an eyelid member visible via each aperture and produces an appearance that the toy figure is closing its eyes.

10. The animated toy figure of claim 9, wherein each eyelid member is weighted, and is movably mounted within the head member, so that the backward pivoting of the head member results in a movement of each eyelid member relative to the head member.

11. The animated toy figure of claim 1, wherein the head member defines two eye apertures, and the toy figure further comprises two eye surfaces movably mounted within the head; such that a portion of each eye surface is visible through an eye aperture, and such that the backward pivoting of the head renders at least another portion of each eye surface visible through each eye aperture, and thereby produces an appearance that the toy figure is closing its eyes.

12. The animated toy figure of claim 1, further comprising a sound generator that is configured to play one or more sound effects upon activation of the activating member.

13. The animated toy figure of claim 1, further comprising a pair of ear members configured so that the backward pivoting of the head causes each ear member to move.

14. The animated toy figure of claim 13, further comprising:

a pair of pivotable ear supports mounted within the head member, wherein each ear support protrudes through an aperture defined by an upper surface of the head member;

each ear member is mounted on one of the ear supports where it protrudes from the head member; and each pivotable ear support is biased towards the rear of the head member, such that the backward pivoting of the head results in pivotal movement of each ear support and an appearance that the toy figure is moving its ears rearward.

15. An animated toy figure comprising:

a torso;

a head that is pivotally coupled to the torso;

wherein the head includes a pair of projecting ears, and a face that has eyes;

a first and a second arm members disposed on opposing sides of the torso; and an activating member disposed on the torso, wherein activation of the activating member concurrently moves the first and second arm members upwardly, tilts the head backwards, moves the ears backwards, and closes the eyes.

16. The animated toy figure of claim 15, further comprising a sound generator that is configured to play a howling sound effect upon activation of the activating member.

17. A method of making a toy figure, the method comprising:

providing a torso member having a neck portion and opposing shoulders, the torso member defining a torso interior;

pivotally coupling a head member to the neck portion of the torso member;

disposing a cross-connector within the torso interior so that one end of the cross-connector is at each shoulder of the torso member, and the cross-connector extends between the opposing shoulders;

coupling a first arm member and second arm member to the ends of the cross-connector, such that the arm members are disposed at opposing shoulders of the torso member, and such that rotation of the cross-connector pivots the first and second arm members around their respective opposing shoulders;

coupling a lifting structure to and between the cross-connector and the head member, such that rotation of the cross-connector urges the lifting structure upward and thereby pivots the head member backwards;

installing an activating member on a rear surface of the torso member; and coupling the activating member to the cross-connector, such that an activation of the activating member rotates the cross-connector, pivots the first and second arm members, urges the lifting structure upward, and tilts the head member backward.

18. The method of claim 17, wherein the head member includes eye apertures, further comprising installing two eye members within the head member so that they are visible via the eye apertures, where each eye member includes an eyelid portion and the eye members are disposed so that the backward pivoting of the head member causes the eyelid portion to become visible via the eye apertures, producing an appearance that the toy figure is closing its eyes.

19. The method of claim 17, wherein the head member includes ear apertures, further comprising installing two ear members so that they extend through the ear apertures and are movably mounted within the head member, so that the backward pivoting of the head member results in a movement of ear.

20. The method of claim 17, further comprising installing a sound generator in the torso member and coupling the sound generator to the activating member so that the sound generator plays one or more sound effects upon activation of the activating member.

* * * * *